United States Patent [19]

Simpson et al.

[11] Patent Number: 4,878,406

[45] Date of Patent: Nov. 7, 1989

[54] SCREWDRIVER BLADE

[75] Inventors: Steven C. Simpson, Napoleon; Warren W. Weible, Defiance, both of Ohio

[73] Assignee: SK Hand Tool Corp., Defiance, Ohio

[21] Appl. No.: 250,166

[22] Filed: Sep. 28, 1988

[51] Int. Cl.[4] ..... B25B 13/48
[52] U.S. Cl. ..... 81/436
[58] Field of Search ..... 81/436, 460

[56] References Cited

U.S. PATENT DOCUMENTS 2,678,578 5/1954 Bonanno ..... 81/436

FOREIGN PATENT DOCUMENTS 3630809 2/1987 Fed. Rep. of Germany ..... 81/436
2031316 4/1980 United Kingdom ..... 81/436

OTHER PUBLICATIONS

Dodds, "Justice for the Lowly Screwdriver", *American Machinist,* Aug. 29, 1946, p. 126.

*Primary Examiner*—Judy Hartman
*Attorney, Agent, or Firm*—Allen D. Gutchess, Jr.

[57] ABSTRACT

A screwdriver blade is provided which has greater resistance to failure. The screwdriver blade includes an elongate shank with a tapered end extending from the shank and terminating in a tip. The tip has a straight edge perpendicular to the shank and is of a predetermined thickness, with parallel, planar sides extending back from the edge a distance which is approximately equal to the thickness of the edge. Opposite surfaces of the blade end then extend abruptly outwardly in a direction toward the shank, each at an angle of approximately fifteen degrees to an axis of the blade. An analysis has indicated that the greatest stress in a screwdriver blade occurs at a predetermined distance back from the straight edge of the blade. The new blade is thicker and stronger at the areas where the greatest stress occurs.

13 Claims, 1 Drawing Sheet

SCREWDRIVER BLADE

This invention relates to a screwdriver blade which has greater resistance to failure.

Screwdrivers, of course, have been long known in the art and screwdriver blades of special shapes to fit special screws have, on occasion, been patented.

The new screwdriver blade in accordance with the invention is designed to fit and drive conventional screws with straight slots. It has been discovered through computer analyses that the greatest stress in screwdriver blades occurs at side edges of the blade tip a predetermined distance back from the end edge of the tip. Failure of the screwdriver blades due to twisting and bending occurs at those areas.

The new screwdriver blade is designed to be thicker and stronger in the areas having the greatest stress. The new screwdriver blade has a shank with a tapered end which terminates in a tip having a straight edge perpendicular to the shank. The straight edge is of predetermined thickness and the tip has parallel, planar sides extending back from the edge to inner edges for a distance approximately equal to the thickness of the tip edge. Opposite surfaces of the blade end then extend rather abruptly outwardly from one another in a direction toward the shank, each at an angle of approximately fifteen degrees to an axis of the blade. These opposite surfaces extend outwardly for a minimum distance of 0.2 inch from the tip edge toward the shank to be beyond the areas of highest stress. From there back to the shank, the included angle is not of particular importance. The side edges of the top taper outwardly toward the shank, each at approximately four degrees to the axis of the blade for a minimum of 0.2 inch from the tip edge.

Tests of the new screwdriver blade compared with conventional blades made of the same metal have shown that the new blade is fifty-one percent stronger.

It is, therefore, a principal object of the invention to provide an improved screwdriver blade having greater resistance to failure.

Another object of the invention is to provide a screwdriver blade which is stronger than those heretofore known.

Other objects and advantages of the invention will be apparent from the following detailed description of preferred embodiments thereof, reference being made to the accompanying drawings, in which.

Figure 1:
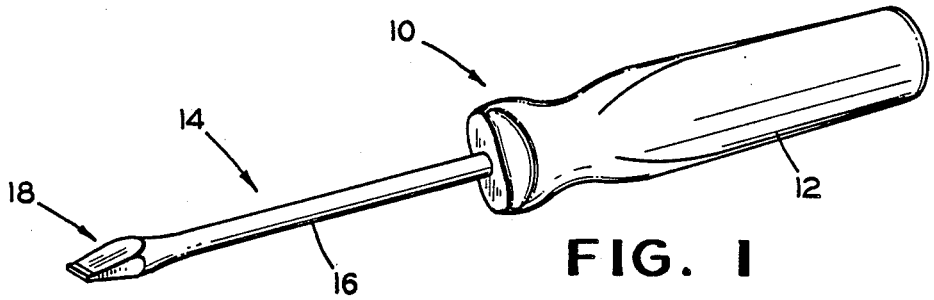
FIG. 1 is a view in perspective of a screwdriver incorporating our new screwdriver blade.
Figure 2:
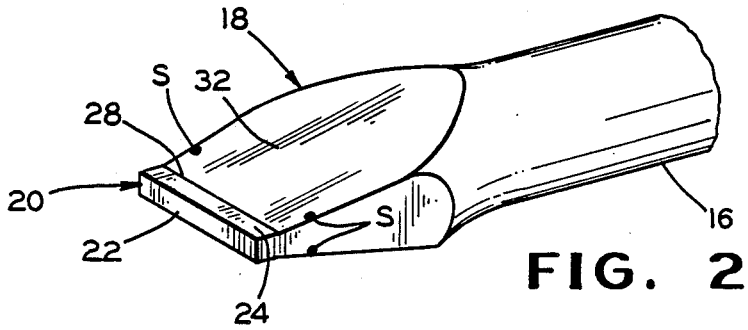
FIG. 2 is an enlarged, fragmentary view in perspective of the new screwdriver blade.
Figure 3:
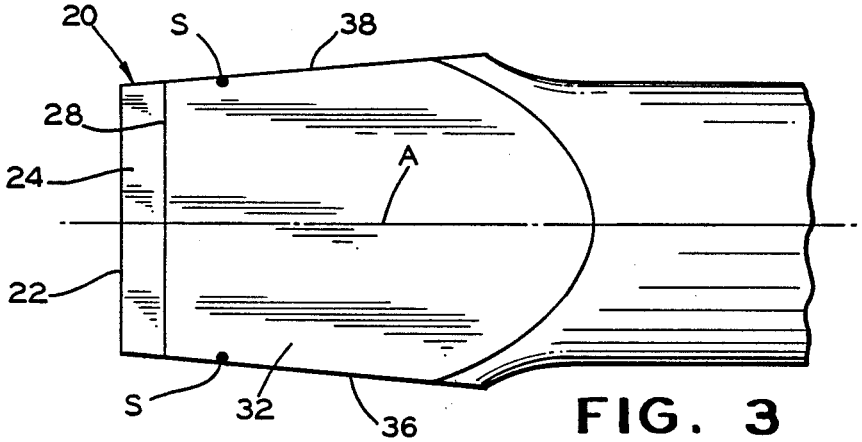
FIG. 3 is a further enlarged, fragmentary, plan view of the new screwdriver blade.
Figure 4:
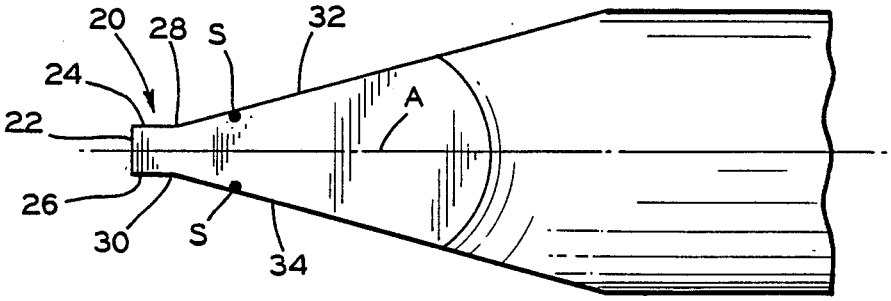
FIG. 4 is a fragmentary, side view of the new screwdriver blade.

Referring to the drawings and particularly to FIG. 1, a screwdriver embodying the invention is indicated at 10 and includes a handle 12 and a blade 14. The blade 14 has an elongate shank 16 and a tapered end 18 terminating in a tip 20. These are symmetrical both vertically and horizontally with respect to a longitudinal axis A (FIGS. 3 and 4).

The tip 20 has a straight edge 22 which is perpendicular to the axis A and is of a predetermined thickness.

The tip 20 further has parallel, planar sides 24 and 26 extending back toward the shank 16 from the edge 22 to inner edges 28 and 30 for a distance which is approximately equal to the thickness of the edge 22. From here, opposite side surfaces 32 and 34 extend outwardly rather abruptly toward the shank 16 from the edges 28 and 30 of the planar sides 24 and 26. The surfaces 32 and 34 each form an angle of ten to twenty degrees, preferably approximately fifteen degrees, with respect to the axis A, as viewed in FIG. 4. As shown, the surfaces 32 and 34 form the same angle until they meet with the shank 16. However, it is only important that the fifteen degree angle be maintained for a distance of 0.2 inch from the straight edge 22 which is beyond points or areas of highest stress in the blade end 18. The angle from there back toward the shank 16 is not critical since it is toward the handle 12 from the stress points or areas on the end 18. The highest stress points or areas are designated with the letter S, these being along the edges of the end 18 and at predetermined distance from the straight edge 22 for any given size of blade.

As mentioned, the parallel sides 24 and 26 of the tip 20 extend back from the edge 22 to the edges 28 and 30 a distance approximately equal to the thickness of the edge 22. Thus, with a quarter-inch screwdriver (in which the length of the edge 22 is 0.250 inch) the thickness of the edge 22 is 0.043 inch and the width of the parallel sides 24 and 26 (the distance they extend back from the edge 22 to the inner edges 28 and 30) is 0.045 inch. With a five-sixteenths inch screwdriver blade, the thickness of the edge 22 is 0.053 inch and the width of the parallel sides 24 and 26 is 0.050 inch. With a three-eighths inch screwdriver blade, the thickness of the edge 22 is 0.058 inch and the width of the sides 24 and 26 is 0.058 inch. For a seven-sixteenths inch screwdriver blade, the thickness of the edge 22 is 0.080 inch and the width of the parallel sides 24 and 26 is 0.078 inch. The width of the parallel sides 24 and 26 should be sufficient to be greater than the maximum depth of the slot of the largest screw with which the screwdriver is normally used. The opposite surfaces then taper outwardly away from one another to provide a thicker cross section for the tip 20 at the high stress areas. The parallel sides 24 and 26 also assure that the tip 20 will engage a screw head at its outer extremeties. With a conventional screwdriver blade, a round screw head may be contacted by the blade tip nearer the center thereof.

Each of edge surfaces 36 and 38 is planar and extends back at least 0.2 inch from the edge 22 at an angle of approximately four degrees with the axis A, as viewed in FIG. 3. Beyond that point, the angles the edges 36 and 38 make with respect to the axis are not as important.

Figure 5:
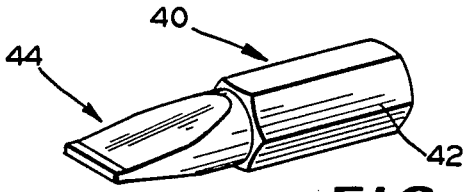
FIG. 5 is a view in perspective of a screwdriver blade incorporating a different shank.

Referring to FIG. 5, a modified screwdriver blade 40 has a shank 42 and a tapered end 44, the shape of which is the same as that of the tapered end 18. The shank 42 is in the form of a bit which is non-circular in transverse cross section and is designed to fit in a corresponding recess of a chuck of a driving tool.

Various modifications of the above-described embodiments of the invention will be apparent to those skilled in the art and it is to be understood that such modifications can be made without departing from the scope of the invention, if they are within the spirit and the tenor of the accompanying claims.

We claim:

1. A screwdriver blade comprising a shank, a tapered end extending from said shank and terminating in a tip, said tip having a straight edge perpendicular to said shank and having a predetermined thickness, said tip having parallel, planar sides extending back toward said shank from said edge to inner edges a distance equal to the thickness of said edge, opposite side surfaces of said end extending abruptly outwardly from one another in a direction toward said shank from said inner edges of said planar sides at angles of ten to twenty degrees with respect to a longitudinal axis of said screwdriver blade.

2. A screwdriver blade according to claim 1 wherein said opposite side surfaces form angles of approximately fifteen degrees with respect to the longitudinal axis of said screwdriver blade.

3. A screwdriver blade according to claim 1 wherein said opposite side surfaces extend abruptly outwardly for a minimum distance of 0.2 inch from said straight edge.

4. A screwdriver blade comprising an elongate shank, a tapered end extending from said shank and terminating in a tip, said tip having a straight edge perpendicular to said shank and having a predetermined length and thickness, said tip having substantially parallel, planar sides extending back toward said shank from said edge to inner edges a distance equal to the thickness of said edge, opposite side surfaces of said end then extending abruptly outwardly from one another in a direction toward said shank from said inner edges of said planar sides.

5. A screwdriver blade according to claim 4 wherein said opposite side surfaces form angles of ten degrees to twenty degrees with respect to a longitudinal axis of said screwdriver blade.

6. A screwdriver blade according to claim 4 wherein said opposite side surfaces form angles of approximately fifteen degrees with respect to a longitudinal axis of said screwdriver blade.

7. A screwdriver blade according to claim 5 wherein side edges of said tip extend outwardly from one another in a direction toward said shank from said straight edge at angles of approximately four degrees with respect to the longitudinal axis of said screwdriver blade.

8. A screwdriver blade according to claim 4 wherein said opposite side surfaces extend abruptly outwardly for a minimum distance of 0.2 inch from said straight edge.

9. A screwdriver blade, which is substantially stronger than a conventional screwdriver blade, comprising an elongate shank, a tapered end extending from said shank and terminating in a tip, said tip having a straight edge perpendicular to said shank and having a predetermined thickness, said tip having parallel, planar sides extending back toward said shank from said edge to inner edges, opposite side surfaces of said end extending abruptly outwardly from one another in a direction toward said shank from said inner edges beyond maximum stress areas of said end at angles of ten degrees to twenty degrees with respect to a longitudinal axis of said screwdriver blade.

10. A screwdriver blade according to claim 9 wherein the width of said planar sides is equal to the thickness of said straight edge.

11. A screwdriver blade according to claim 9 wherein said opposite side surfaces extend toward said shank for a minimum distance of 0.2 inch from said straight edge.

12. A screwdriver blade according to claim 9 wherein said opposite side surfaces form angles of approximately fifteen degrees with respect to a longitudinal axis of said screwdriver blade.

13. A screwdriver blade according to claim 9 wherein the width of the planar sides between said straight edge and said inner edges is greater than the maximum depth of the slot of the largest screw with which the screwdriver will normally be used.

* * * * *